United States Patent [19]

Koepp

[11] 4,148,018

[45] Apr. 3, 1979

[54] ALARM SOUNDER FOR A.C. OPERATED SOLID STATE DEVICES

[75] Inventor: Ronald L. Koepp, Sunnyvale, Calif.

[73] Assignee: Fairchild Camera and Instrument Corporation, Mountain View, Calif.

[21] Appl. No.: 803,096

[22] Filed: Jun. 3, 1977

[51] Int. Cl.[2] ..... G08B 3/00

[52] U.S. Cl. ..... 340/401; 340/402; 340/384 E

[58] Field of Search ..... 340/401, 391, 402, 384 R, 340/384 E; 58/38 R

[56] References Cited

U.S. PATENT DOCUMENTS

| | | | |
|---|---|---|---|
| 2,757,365 | 7/1956 | Perez | 340/401 |
| 3,888,075 | 6/1975 | Wecker | 58/38 R |

*Primary Examiner*—Harold I. Pitts

*Attorney, Agent, or Firm*—Alan H. MacPherson; Robert C. Colwell; Paul J. Winters

[57] ABSTRACT

An alarm sounder for use with solid state integrated clock circuits employs an amplifying transistor controlled by the clock alarm output signal that contains an A.C. component to control the current through a coil, the core laminations of which magnetically actuate a metal reed that is audibly vibrated by utilizing a spring against the core and/or an adjacent member at the frequency of the A.C. component.

12 Claims, 2 Drawing Figures

ALARM SOUNDER FOR A.C. OPERATED SOLID STATE DEVICES

This invention relates to audible alarms and particularly to an electromagnetic sounder actuated by the alarm output signals from A.C. powered electronic devices such as electronic clocks or clock radio modules.

BRIEF SUMMARY OF THE INVENTION

Several types of alarm sounders are presently used by electronic alarm clock and clock radio manufacturers and, with the exception of one type that outputs A.C. pulses by tapping into a portion of a digital pulse train signal, amplifies it, and reproduces it through a speaker, all alarm sounders are D.C. operated. Thus, it is necessary to rectify and filter the input A.C. power to either operate a D.C. buzzer alarm, or to drive D.C. tone oscillators which, in turn, drive a small speaker or ear phone element.

Digital clock modules do not require highly filtered D.C. to operate their optical displays or output circuits that control the clock alarm and/or power a radio receiver. Hence, the D.C. power applied to that portion of a clock module may contain an A.C. ripple. It is this A.C. ripple component in the D.C. that is used by the invention to generate an audible alarm.

Briefly described, the invention includes a transistor switch that is controlled by the D.C. alarm output signal of an integrated-circuit clock module. This D.C. signal contains a large A.C. ripple that varies the current through an amplifying transistor. In series with the transistor collector is the alarm element comprising a coil, the core laminations of which magnetically actuate a metal reed that is caused to audibly vibrate by utilizing a spring between the core and either the housing or adjacent member at the frequency of the A.C. component.

DESCRIPTION OF THE DRAWINGS

In the drawings illustrating the preferred embodiment of the invention.

DETAILED DESCRIPTION OF THE PREFERRED EMBODIMENTS

Figure 1:
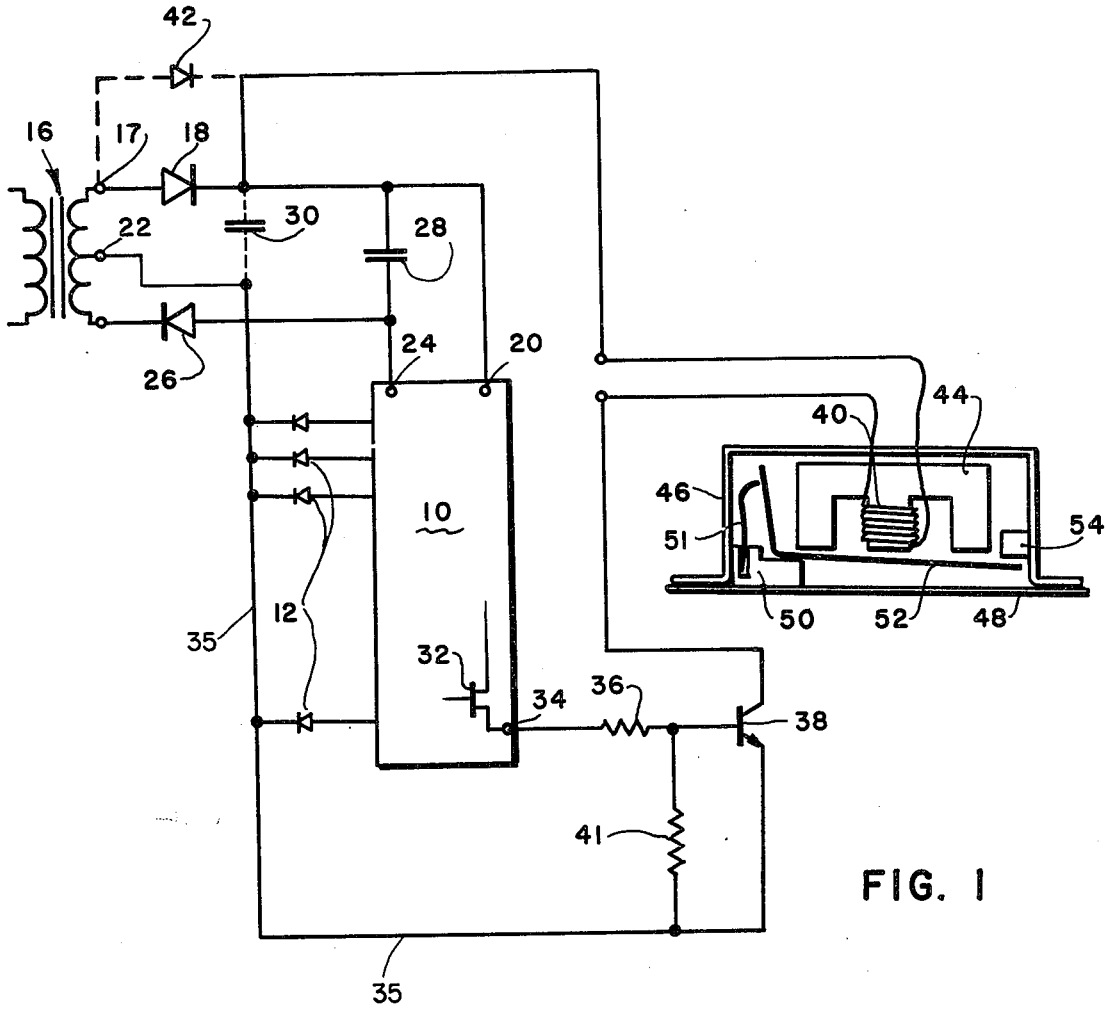
FIG. 1 is a schematic diagram illustrating a typical digital clock module and alarm sounder of the invention.

Turning now to FIG. 1 of the drawings, a solid state metal-oxide semiconductor (MOS) alarm clock or clock radio module 10 typically generates output signals to a plurality of light-emitting diodes (LED's) 12 arranged in a bank of standard 7-segment numerical displays for indicating time in hours and minutes. The module 10 is powered from an A.C. source through a transformer 16 having a secondary winding, the first terminal 17 of which is coupled to the anode of the diode 18, the cathode of which is connected to the positive voltage input terminal 20 of the module 10. In the embodiment illustrated, the LED cathodes are connected together and to a center tap 22 in the secondary winding of the power transformer 16, while the negative or drain voltage terminal 24 of the module 10 is coupled to the anode of a diode 26, the cathode of which is connected to the second terminal of the secondary winding of transformer 16.

Filtering of the voltages across the secondary of the transformer 16 is accomplished by the capacitor 28 coupled across the terminals 20 and 24 of the module 10; a capacitor 30, shown as connected by a dashed line in FIG. 1, is often coupled between the terminal 20 of the module 10 and the LED common cathode conductor 35 to the center tap 22. Clock module LED display circuits do not require extensive filtering, and hence the capacitor 30 is usually omitted from the circuit so that the D.C. power signal applied to the module contains a large ripple component. This A.C. ripple does not deleteriously affect the operation of the LED circuitry and associated output control circuitry of the module 10.

In a typical MOS alarm clock or clock radio module, the various logic circuits within the module control output field-effect transistors (FETs) that interconnect the positive voltage with external radio or alarm sounding devices. Heretofore, the alarm sounders have been D.C. operated and controlled by the alarm output signal from the module. In the invention, however, the D.C. alarm signal with the A.C. ripple component is applied by a FET 32 within the module 10 to the output terminal 34 and through a resistance 36 to the base of an amplifying NPN transistor 38. The emitter of transistor 38 is coupled through the LED common cathode conductor 35 to the center tap 22 of power transformer 16 and, if the filter capacitor 30 is omitted and the large A.C. ripple is present, the collector of transistor 38 is coupled through a coil 40 to the positive terminal 20 of the module 10. A resistor 41 coupled between the base and emitter of transistor 38 assures that the transistor 38 is in its normally off state in the absence of an alarm output from the module 10.

If, however, the filter capacitor 30 is used, the A.C. ripple may not be present in the display circuit. Then, the collector of transistor 38 should be coupled through the coil 40 to the cathode of a half-wave rectifying diode 42, the anode of which is connected to the terminal 17 on the secondary winding of the power transformer 16, as shown by the dashed lines in the schematic drawing of FIG. 1.

The coil 40 is wound around a laminated core 44 that may be mounted in a housing 46 that preferably has a thin floor 48. Positioned within the housing 46 at the junction of one wall with the floor 48 is a U-shaped member 50 which supports one end of a resilient spring 51, the opposite end of which exerts a force against a metal strip or reed 52. As shown in FIG. 1, metal reed 52 has a flat portion positioned to underlie the core 44. If desired, the U-shaped member 50 may be omitted and the spring 51 may be welded or riveted directly to the wall of housing 46. The spring 51 and the reed 52 are L-shaped. Spring 51 provides a force that urges the reed 52 away from the core 44 so that, when the core 44 is energized, the magnetic attraction upon the reed 52 must overcome the spring force to permit the unattached end of the reed 52 to audibly strike the sounding protrusion 54 positioned on the opposite wall of the housing 46. It should be pointed out that the bottom or striking surface of the sounding protrusion 54 should be slightly lower than the bottom surface of the core 44 to facilitate the breaking away of the reed 52 upon release of the magnetic field by the core 44.

The alarm sounder element illustrated in FIG. 1 generates an audible sound upon both the peak and release of the magnetic field as the reed 52 contacts the sounding means — i.e., the housing floor 48 and the sounding protrusion 54 in this embodiment. The spring 51 is essential to the invention for enabling the reed 52 to strike the sounding means with sufficient force to create a sound resonably audible to the human ear when the reed 52 hits the sounding means. The reason, in simple terms, is that the reed 52 alone does not have sufficient mechanical flexibility to vibrate through the necessary amplitude for the relatively low amount of A.C. supplied to the coil 40. The spring 51 provides the necessary amount of flexibility.

Figure 2:
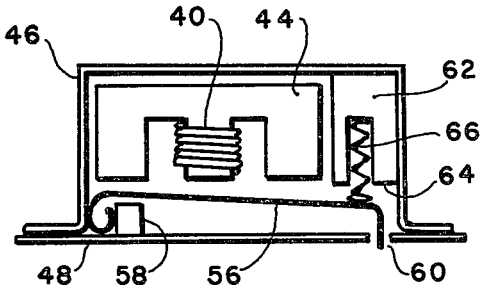
FIG. 2 is an elevation view schematically illustrating an alternate configuration of the alarm sounder.

FIG. 2 is a sectional elevation view of an alternative configuration of an alarm sounder that generates its noise upon release of the magnetic field. As shown in FIG. 2, the laminated core 44 containing the coil 40 is positioned within a housing 46 having a floor 48. A soft iron strip or reed 56 is preferably mounted between one wall of the housing 46 and a ledge 58 extending from the floor 48. The reed 56 is loosely locked between the wall and the ledge and has a straight section which overlies the core 44 and then is abruptly bent downward to extend through a hole 60 in the floor 48. Positioned above hole 60 is a spring-retaining block 62 having a lower surface 64 that is slightly lower than the bottom surface of the core 44. Positioned within a hole in the bottom surface of the retaining block 62 is a compression spring 66 which is positioned to urge the reed 56 away from the core 44. Thus, the reed 56 will be attracted toward the core 44 as the A.C. ripple current builds up the magnetic field in the core 44 and, upon release of the magnetic field, the reed 56 will release to strike any sounding member positioned below the hole 60 in the floor 48. For example, a thin metallic diaphragm member can be positioned below the hole 60 to mechanically amplify the audible sound generated when the reed 56 strikes the diaphragm. If desired, the hole 60 may be omitted so that the reed 56 merely strikes the floor 48 which then constitutes part of the sounding means.

In operation, the module 10 will, at a preselected time, apply a voltage to the gate element of the FET 32 so that the D.C. alarm output signal will be applied to the base of the transistor amplifier 38. If the display circuit of the module 10 is not filtered, the transistor amplifier 38 will amplify the ripple signal to cause the transistor amplifier 38 to apply to the coil 40 an alternating current that generates corresponding flux variation in the laminated core 44, thereby magnetically vibrating the reed 52 or 56 in the sounder. If, on the other hand the module display circuit is filtered by the addition of the filter capacitor 30, the D.C. output of the FET 32 will cause transistor 38 to act as a gate to pass a direct current with a strong A.C. ripple from the terminal 17 and through diode 42 and coil 40.

In both of the modes of operation outlined above, the coils 40 must conduct a direct current with the A.C. ripple component. The direct current will, of course, produce a continuous magnetic attraction by the core 44 upon the reed 52 or 56. This D.C. magnetic attraction is overcome by appropriate adjustment of the spring elements associated with each reed. Thus, in FIG. 1, the straight portion of reed 52 underlying the core 44 is acted upon by a spring member 51 which is appropriately stressed to urge the reed away from core 44 while a pure D.C. component is applied to the coil 40. Similarly, in FIG. 2, the spring 66 is sufficiently strong to urge the reed 56 from the core 44. Furthermore, the protrusion 54 in the sounder illustrated in FIG. 1 prevents the reed 52 from making contact with the core 44 to facilitate release of the reed 52 upon discontinuance of the A.C. component. This same feature is incorporated in FIG. 2 by the positioning of the lower surface 64 of the spring-retaining block 62. Thus, with mechanical restrictions for cancelling the effects of the direct current flow through the coil 40, the reeds 52 in FIG. 1 and 56 in FIG. 2 may be closely adjusted to react only in response to the A.C. ripple component.

I claim:

1. An alarm sounder for use with alternating current (A.C.) powered circuitry having signalling means for producing an alarm output signal, said alarm sounder comprising:

a housing;

a laminated magnetic core located within said housing;

a coil wound around part of said core;

electronic circuit means connected in series with said coil and operable by said signalling means for supplying an unfiltered first direct current (D.C.) with a first A.C. ripple component to said coil;

a reed positioned adjacent to said core, said reed forming part of the magnetic circuit of said core and being magnetically attracted toward said core by said first D.C. flowing through said coil;

spring means contacting said reed during selected time periods and exerting sufficient force on said reed to overcome the magnetic attraction caused by said first D.C. flowing through said coil;

spring-retaining means for mounting said spring means, said spring-retaining means contacting the interior of said housing; and sounding means positioned adjacent to said reed, said first A.C. ripple component through said coil generating an alternating core flux that causes said reed to vibrate audibly against said sounding means at the frequency of said first A.C. ripple component.

2. The sounder claimed in claim 1 wherein said spring means have sufficient mechanical flexibility to enable said reed to vibrate audibly against said sounding means.

3. The sounder claimed in claim 1 wherein at least part of said sounding means comprises at least part of said housing.

4. The sounder claimed in claim 1 wherein said reed is rigidly fixed at one end to said spring means.

5. The sounder claimed in claim 1 wherein said reed audibly vibrates against said sounding means upon the peaking of the magnetic field in said core.

6. The sounder claimed in claim 1 wherein said reed audibly vibrates against said sounding means upon the release of the magnetic field in said core.

7. The sounder claimed in claim 4 wherein said A.C. powered circuitry includes a plurality of light-emitting diode (LED) display elements having a common cathode return and wherein said electronic circuit means is connected between said common cathode return and the positive voltage input source to said A.C. powered circuitry.

8. The sounder claimed in claim 7 wherein said signalling means supplies a second D.C. with a second A.C. ripple component to said electronic circuit means and wherein said electronic circuit means includes at least one amplifier for amplifying said second A.C. ripple component to create said first A.C. ripple component.

9. The sounder claimed in claim 1 wherein said first D.C. with said first A.C. ripple component comprises a half-wave rectified A.C. and wherein said A.C. powered circuitry includes a half-wave rectifier connected to said electronic circuit means for generating said half-wave rectified A.C.

10. The sounder claimed in claim 2 wherein said reed is rigidly fixed at one end to said spring means.

11. The sounder claimed in claim 10 wherein said A.C. powered circuitry includes a plurality of LED display elements having a common cathode return and wherein said electronic circuit means is connected between said common cathode return and the positive voltage input source to said A.C. powered circuitry.

12. The sounder claimed in claim 11 wherein said signalling means supplies a second D.C. with a second A.C. ripple component to said electronic circuit means and wherein said electronic circuit means includes at least one amplifier for amplifying said second A.C. ripple component to create said A.C. ripple component.

* * * * *